United States Patent [19]

Nishio et al.

[11] Patent Number: 5,030,401

[45] Date of Patent: Jul. 9, 1991

[54] METHOD FOR MOLDING POWDERS

[75] Inventors: Hiroaki Nishio; Hideharu Yamamoto; Jun Harada; Takeshi Kawashima, all of Tokyo, Japan

[73] Assignee: NKK Corporation, Tokyo, Japan

[21] Appl. No.: 470,959

[22] Filed: Jan. 26, 1990

[30] Foreign Application Priority Data

Apr. 18, 1989 [JP] Japan ..... 1-96458

[51] Int. Cl.[5] ..... B22F 3/02; B29C 43/10; B29C 33/40

[52] U.S. Cl. ..... 264/102; 264/123; 264/221; 264/225; 419/68

[58] Field of Search ..... 264/102, 109, 123, 220, 264/221, 225, 226; 425/405.1, 405.2; 419/68

[56] References Cited

U.S. PATENT DOCUMENTS

| | | | |
|---|---|---|---|
| 4,552,779 | 11/1985 | McClure | 427/2 |
| 4,615,855 | 10/1986 | Orlowski et al. | 264/221 |
| 4,761,264 | 8/1988 | Nishio et al. | 419/68 |
| 4,777,002 | 10/1988 | Patz | 264/226 |
| 4,812,278 | 3/1989 | Natori et al. | 264/221 |
| 4,927,600 | 5/1990 | Meyashita et al. | 419/49 |

FOREIGN PATENT DOCUMENTS

| | | | |
|---|---|---|---|
| 0249936 | 12/1987 | European Pat. Off. | 419/68 |
| 0286713 | 12/1987 | Japan | 264/221 |
| 0294103 | 12/1987 | Japan | 419/68 |
| 62-297402 | 12/1987 | Japan . | |

*Primary Examiner*—Mary Lynn Theisen

*Attorney, Agent, or Firm*—Frishauf, Holtz, Goodman & Woodward

[57] ABSTRACT

A method for molding powders to form a shaped compact comprising the steps of forming a thin-wall resilient mold having an outer surface and having at least one opening adjacent a surface of a model of a desired shape, forming a mold support on the outer surface of the thin-wall resilient mold, so that the mold support adheres to the outer surface of the thin-walled resilient mold, removing the model from the thin-wall resilient mold whereby a cavity is formed in a portion of the thin-wall resilient mold, from which the model is removed, filling up the cavity of the thin-wall resilient mold with a powder as a forming material through the opening, sealing the opening of the thin-wall resilient mold after having evacuated air from the inside of the thin-wall resilient mold, removing the mold support from the thin-wall resilient mold, subjecting the thin-wall resilient mold filled with the powder to a cold isostatic press. The mold support can be made by cast molding or by applying a material such as water-glass, a hydrolysis liquid of metal alkoxide, liquid polyurethane resin, liquid epoxy resin or liquid gypsum.

30 Claims, 1 Drawing Sheet

METHOD FOR MOLDING POWDERS

BACKGROUND OF THE INVENTION

1 Field of the Invention

The present invention relates to a method for efficiently manufacturing a compact from powders which contracts only a little anisotropically.

2 Description of the Prior Arts

In the prior art cold isostatic press method, a resilient mold is filled up with powders such as metallic powder, ceramic powder or the like and sealed. Then, an isostatic press is applied to the resilient mold by the use of a pressure medium at the normal temperature whereby a homogeneous compact is prepared. Hereinafter, the cold isostatic press method is abbreviated as a C.I.P. method. In the forgoing C.I.P. method, however, some idea is required to obtain a compact of desirable shape so that the resilient mold cannot be deformed by the weight of the powders. In this connection, a method wherein a thickness and a strength of the resilient mold are made large to some extent is known. In this method, however, a degree of contraction of the resilient mold relative to a pressure applied thereto is different from a degree of contraction of a fill-up of powders inside the resilient mold, to which a pressure is applied. Due to the difference in the degrees of the contraction, the resilient mold and fill-up do not contract isotropically. Accordingly, the compact is required to be subjected to considerable machining in order to obtain a desired shape and a dimensional accuracy.

A method disclosed in a Japanese Examined Patent Publication No. 297402/87 is pointed out as another method. This method is executed as follows:

(a) A thin-wall resilient mold of a predetermined shape and a ventilative mold support having an inside shape similar to the shape of the resilient mold are prepared;

(b) The resilient mold is inserted into the mold support;

(c) The resilient mold is put close to the inner surface of the mold support;

(d) The resilient mold, which has been put close to the inner surface of the mold support and whose shape is kept, is filled up with powder materials. Then, after air in the resilient mold has been exhausted, the resilient mold is sealed;

(e) The ventilative mold is removed from the thin-wall resilient mold; and (f) The thin-wall resilient mold is subjected to a cold isostatic press treatment and is removed whereby a compact is prepared.

A great progress in an increase of dimensional accuracy is seen in the method disclosed in the Japanese Patent Application Laid Open No. 297402/87 in comparison with the method wherein the thickness and strength of the resilient mold are made large to some extent. However, since the resilient mold is expanded by the use of the pressure difference and put close to the inner surface of the ventilative mold support, there occurs a phenomenon such that the resilient mold expands, not moving to positions corresponding to due positions of the inner surface of the mold support similar in shape to the resilient mold. When the resilient mold, in which said phenomenon takes place, is subjected to the C.I.P. treatment as it is, there occurs an anisotropic contraction and creases of the resilient mold. The more a desired shape of a compact becomes complicated, the greater this problem is posed.

SUMMARY OF THE INVENTION

It is an object of the the present invention to manufacture a compact of high dimensional accuracy with good repeatability. To accomplish the foregoing object, the present invention provides a method for molding powders, comprising the steps of:

forming a thin-wall resilient mold having at least one opening on a surface of a model of a desired shape;

forming a mold support so that said mold support can be put close to an outer surface of said thin-wall resilient mold;

removing said model from said thin-wall resilient mold, a cavity being formed in a portion, from which said model is removed;

charging powders as a forming material from said opening into the cavity of the thin-wall resilient mold;

sealing said opening of the thin-wall resilient mold after having removed air in the thin-wall resilient mold;

removing the mold support from the thin-wall resilient mold; and subjecting the thin-wall resilient mold filled up with powders to a cold isostaitic press treatment.

The above objects and other objects and advantages of the present invention will become apparent from the detailed description which follows, taken in conjunction with the appended drawings.

DESCRIPTION OF THE PREFERRED EMBODIMENTS

Figure 1:
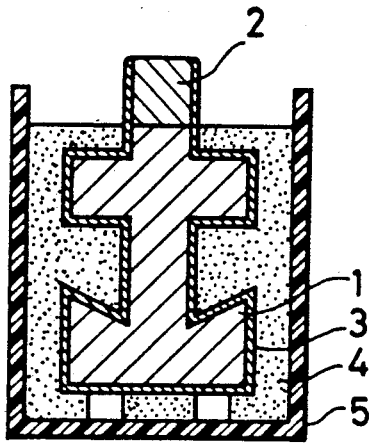
FIG. 1 is an elevational sectional view illustration of a state such that a model, on a surface of which a thin-wall resilient mold is formed, is put into a crate, thereby a mold support being formed, according to the present invention.

A model of a desired shape can be made of materials not easily deformed in the case of being capable of taking the model out of the thin-wall resilient mold as a single body or by means of dividing. A wide range of materials can be selected as the materials for the mode. Metal, ceramics, plastic, wood or the like are used for the materials for the model. On the other hand, in case the model is hard to take out even by means of dividing it, materials capable of being taken out of the thin-wall resilient mold or being made to disappear by means of melting, dissolving or sublimating the materials are selected within a range, in which the functions of the thin-wall resilient mold and mold support are not impaired. Wax or the like is pointed out as a material capable of being removed from the thin-wall resilient mold by means of melting. PVA, PVB, PEG, MC, CMC, urea or the like are pointed out as materials capable of being removed by dissolving into water or an organic solvent. Napthalene or the like is pointed out as a material capable of being removed by means of sublimating. Out of those materials, wax easy to form is particularly desirable. Powders of metal, ceramics, plastic, wood or the like can be mixed with the above-mentioned materials to adjust the strength, rigidity or the like.

Methods of making a model of a desired shape are not particularly limited. A large lump of material can be machined. Material can be melted and cast into a mold of a desired shape. An injection molding of material in the state of being melted or semi-coagulated can be made.

The thin-wall resilient mold is a mold made of natural rubber or synthetic rubber and high in elasticity. Styrene-butadiene rubber, polyisoprene rubber, isobutylene rubber, isoprene rubber, silicone rubber and urethane rubber or the like is used as the synthetic rubber. A wall thickness of the thin-wall resilient mold varies dependent on sizes and shapes of the mold. The wall thickness of the mold are usually within a range of 50 to 2000 μm. Materials for rubber in the state of liquid or paste are applied on the whole surfaces of the model except for portions corresponding to portions to be filled up with powders. Applied materials are converted to the thin-wall resilient mold, being cured. There can be a plurality of positions which are to be filled up with powders. Means for applying the materials on the surfaces of the mold are not particularly limited. Applying the materials on the surfaces of the model by the use of a brush, dipping the model in the materials or spraying the materials on the model or the like can be applied. A mold releasing agent or an adhesive agent can be applied in advance on the thin-wall resilient mold in order to control the adhesive property of the model with the mold support. A function of the thin-wall resilient mold is to transfer a pressure applied to a liquid from the outside to a compact inside the resilient mold and to enable the compact to contract isostatically, following a contraction of the compact.

The mold support is made by a cast molding or an application of materials. Means for the application of materials are not particularly limited. The application of materials by the use of a brush, dipping into materials and spraying materials or the like can be applied. In the case of the use of cast molding, liquid polyurethane resin, liquid epoxy resin and liquid gypsum are applied. The mold support is formed by curing those materials. Metallic powder, ceramic powder, plastic powder or the like can be mixed with the materials to control strength and rigidity of the mold support. On the other hand, in the case of using the application of materials, water-glass, hydrolysis liquid of metal alkoxide, liquid polyurethane resin, liquid epoxy resin and liquid gypsum can be applied. In the case of using the application of materials also, powders can be mixed with the materials.

The mold support plays the role of preventing the thin-wall resilient mold from being deformed. Therefore, an appropriate adhesive property between the thin-wall resilient mold and the mold support except for sufficient rigidity and strength of the mold support is required. In many cases, the mold is vibrated when a cavity is filled up with material powders. When the thin-wall resilient mold is separated from the mold support under the influence of vibrations of the mold and friction working between powders and the thin-wall resilient mold in connection with movement of filled powders, a predetermined shape of a compact cannot be obtained due to an insufficient fill-up.

After the mold support has been formed, the model is removed. The model is removed dependent on the sort of the model used. For example, in case it is possible to take the model out of the thin-wall resilient mold as a single body or by dividing the model, the model is taken out of the mold as a single body or by dividing the model into several parts. In the case of removing the model by melting, the model is melted by heating and made to flow out of the thin-wall resilient mold. In the case of removing the model by dissolving, the model is dissolved by a solvent. In the case of removing the model by dissolving, the model can be heated if necessary. The model is sublimated by heating or reduction of pressure. Melting, dissolving or sublimating the model as described above does not need to be completely carried out. The model can be melted, dissolved or sublimated to the extent that the thin-wall resilient mold and mold support are not impaired. A cavity is formed in a portion of the mold, out of which the model has been taken.

The cavity formed in such a manner is filled up with powders such as metallic powder, ceramic powder or the like which are used for molding materials. The powders such as metallic powder, ceramic powder or the like can be any material, which can be molded by means of the C.I.P. For example, stainless steel powder, high-speed tool steel powder, a mixed powder of tungsten carbid-cobalt, alumina powder, silicon nitride powder, silicon carbide powder, titanium diboride powder or the like are pointed out. Those powders can be used by mixing two sorts of powders or more out of those powders. Powders of about 10 to 1000 μm in particle size are preferable. Spherical powders are desired. Powders can be pelletized to obtain the spherical powders. Various sorts of additives can be added to the powders responsive to properties required for the compact. In case the powder is silicon nitride powder, for example, alumina, yttria or the like is added to the powder. The cavity is filled up with powders through an opening of the thin-wall resilient mold.

Air inside the thin-wall resilient mold can be exhausted after the cavity of the thin-wall resilient mold has been filled up with powders. Air is easily exhausted when the cavity of the thin-wall resilient mold is filled up with powders. A degree of air exhaustion is determined in accord with purposes of the use of the compact. A high degree of vacuum is desired if it is economically allowable.

On the other hand, it is necessary to exhaust air inside the thin-wall resilient mold and to remove the mold support after the thin-wall resilient mold has been sealed. When the mold support is removed, the mold support is desired to be separated from the thin-wall resilient mold without breaking it. A fill-up contracts slightly when the air inside the thin-wall resilient mold is exhausted. The mold support is most desired to separate from the thin-wall resilient mold with this contraction. Accordingly, the mold support is desired to have a weak adhesive property. A mold releasing agent or an adhesive agent can be applied in advance on the surfaces of the thin-wall resilient mold in order to control the adhesive property.

The powders charged into the thin-wall resilient mold in a vacuum can easily hold a shape of a compact thanks to the difference in pressures from the inside and outside. Therefore, the powders can be subjected to C.I.P. treatment by the use of publicly-known methods. When the thin-wall resilient mold is removed after the C.I.P. treatment has been carried out, a compact having been contracted isostatically can be obtained. Since an excessive protrusion is usually formed in a portion of an opening, through which the powders are charged into the thin-wall resilient mold, this protrusion is removed.

As described above, according to the present invention, after the thin-wall resilient mold has been formed, a weakly adhesive mold support is formed successively, the shape of the thin-wall resilient mold being left as it is. Therefore, it is unnecessary to take the thin-wall resilient mold apart and to fit it to the mold support. Accordingly, any crease and any stress distribution do not occur on the surfaces of the thin-wall resilient mold. In consequence, any anisotropic contraction of a compact is hard to occur in comparison with that made by the use of the prior art method and transcription of a model is made very well.

EXAMPLE 1

An example of the present invention will be described with specific reference to FIG. 1. Model 1 was made by carving a lump having a paraffin wax of melting point of 48° to 50° C. Model 1 had a shaft of 40 mm in diameter and a length of 160 mm, a disk of 120 mm in diameter and 40 mm in thickness and a disk of miscellaneous shapes of 40 to 60 mm in thickness. A cylindrical Cylindrical wood spacer 2 of 40 mm in diameter and 40 mm in length was made to adhere to an upper portion of the model 1. A latex of natural rubber was applied on the whole surface of the model 1 except for an upper portion of the spacer 2 by the use of a brush. The model 1 was left as it was at room temperature for three hours. As a result, a film of 0.5 to 1 mm in thickness was made. The film formed in this way was a thin-wall resilient mold 3. The model 1, by the use of which a thin-wall resilient mold had been made, was set inside crate 5. Material made by kneeding burnt gypsum with water was poured between the model 1 and the crate 5 up to an upper end of the model 1 and was left as it was for 24 hours. The material made by kneading burnt gypsum with water was cured whereby mold support 4 was obtained. Then, the spacer 2 was taken out of the thin-wall resilient mold 3. The thin-wall resilient mold 3 was put into a heating furnace and held there at 55° C. for three hours. Paraffin wax inside the thin-wall resilient mold melted. Molten wax was discharged out of the thin-wall resilient mold. As a result, a cavity to be filled up with powders was formed.

The thin-wall resilient mold, in which the cavity to be filled up with powders had been formed, was put on a vibration table. The cavity was filled up with granulated powder of alumina up to about 10 mm above a level corresponding to an upper end of the model, the thin-wall resilient mold being vibrated. Subsequently, an adapter connected to a vacuum pump was fitted to the thin-wall resilient mold and the inside of the thin-wall resilient mold was evacuated to 40 Torr. After the evacuation of air, a rubber just under the adapter was squeezed and clamped from the outside. During the evacuation of air, separation of rubber from gypsum due to a slight contraction of a fill-up was observed. As a result, the fill-up was taken out without damage by breaking gypsum. The fill-up was subjected to the C.I.P. treatment at a pressure of 5000 kg/cm$^2$. A rubber film of the thin-wall resilient mold was separated and a compact was obtained. Obtained compact had been contracted by 28.6% smaller than the model. The compact, however, had contracted uniformly and its transcription of the model was good. The above-described operation was repeated ten times, but there was not any failure and repeatability was good.

EXAMPLE 2

Figure 2:
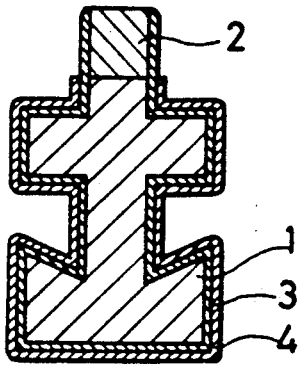
FIGS. 2 and 3 are elevational sectional view illustrations such that a mold support is formed by applying a liquid on a thin-wall resilient mold according to the present invention.

An example of the present invention will be described with specific reference to FIG. 2. Thin-wall resilient mold 3 of natural rubber was formed on model 1 made of paraffin wax by the same procedure as that in Example-1. Slurry was applied on the surfaces of the thin-wall resilient mold 3 in ten layers. Applied liquid was made into a slurry by dispersing 10 wt.% of alumina particles of 0.3 to 0.6 mm in particle size in colloidal silica. Mold support 4 of 2 to 4 mm in thickness was formed by repeatedly applying and drying liquid. Subsequently, spacer 2 was taken out of the thin-wall resilient mold 3. The thin-wall resilient mold 3, by the use of which the mold support was formed, was heated and held in a heating furnace at 55° C. for three hours. The thin-wall resilient mold was taken out of the heating furnace and molten wax was discharged. In this way, a cavity to be filled up with powders was formed.

Figure 4:
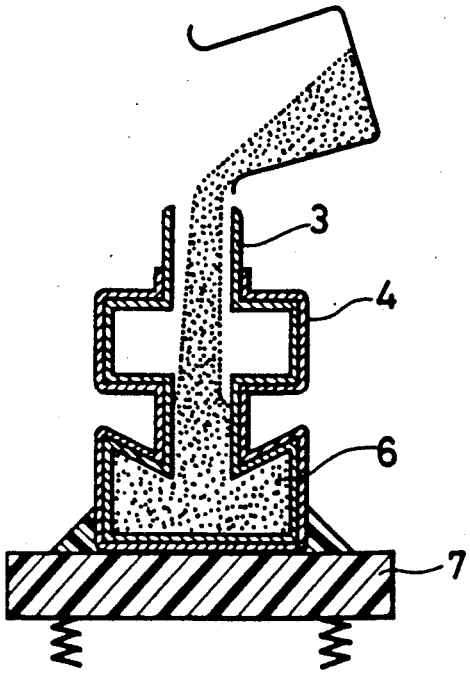
FIG. 4 is an elevational sectional view illustrations such that the thin-wall resilient mold, on which a mold support is formed and which has a cavity, is put on a vibration table and filled up with powders.

The thin-wall resilient mold, in which the cavity to be filled up with powders was formed, was put on a vibration table as shown in FIG. 4 and was filled up with granulated alumina 6. Thanks to a separation of the thin-wall resilient mold 3 from the mold support 4 during evacuation of the inside of the mold support, the thin-wall resilient mold could be removed without impairing the thin-wall resilient mold 3 by breaking hardened layers of the mold support 4. A fill-up was subjected to C.I.P. treatment. A rubber film of the thin-wall resilient mold was separated and a compact was obtained. Isostatic contraction and a transcription property of the obtained compact were good. Even though preparation of the compact was repeated ten times, there was no failure and repeatability was good.

EXAMPLE 3

Figure 3:
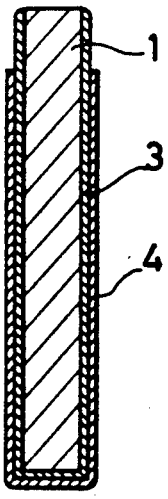

An example of the present invention will be described with specific reference to FIG. 3. Cylindrical model 1 of 40 mm in diameter and 280 mm in length which was made of nylon was used. Thin-wall resilient model 3 of 0.5 to 1 mm in thickness was formed by dipping the model 1 into latex of natural rubber and drying it. Mold support 4 was formed by applying a liquid consisting of colloidal silica and alumina on the surfaces of the thin-wall resilient mold 3. Subsequently, when the model 1 was taken out of the thin-wall resilient mold 3, a cavity, whose shape was similar to the shape of the inside of the thin-wall resilient mold and whose shape was held by the mold support 4 was not deformed, was formed. After the cavity to be filled up with powders has been filled up with granular particles of alumina in accordance with the same procedure as that of Example-1, evacuated and sealed, a fill-up was subjected to the C.I.P. treatment. As a result, a compact good in an isostatic contraction and a transcription property was obtained. Even though the operations were ten times repeated, there was not any failure and repeatability was good.

What is claimed is:

1. A method for molding powders to form a shaped compact comprising the steps of:

forming a thin-wall resilient mold around outer surfaces of a model of a desired shape, said thin-wall resilient mold having at least one opening;

forming a mold support around and in conforming contact with outer surfaces of said thin-wall resilient mold;

removing said model from said thin-wall resilient mold whereby a cavity is formed in a portion of said thin-wall resilient mold from which said model is removed;

filling said cavity of the thin-wall resilient mold with a powder as a forming material through said opening;

sealing said opening of the thin-wall resilient mold after having evacuated gas from the inside of the thin-wall resilient mold;

removing said mold support from the thin-wall resilient mold; and subjecting said thin-wall resilient mold filled with said powder to a cold isostatic press treatment.

2. The method of claim 1, wherein said model is made of a material selected from the group consisting of metal, ceramics, plastic and wood.

3. The method of claim 1, wherein said model is made of material removable by melting.

4. The method of claim 3, wherein said material removable by melting is wax.

5. The method of claim 1, wherein said model is made of a material removable by dissolving said model in water or an organic solvent.

6. The method of claim 1, wherein said model is made of a material which can be removed by sublimation.

7. The method of claim 1, wherein said thin-wall resilient mold is made of natural rubber.

8. The method of claim 1, wherein said thin-wall resilient mold is made of synthetic rubber.

9. The method of claim 8, wherein said synthetic rubber is selected from the group consisting of styrene-butadiene rubber, polyisoprene rubber, isobutylene rubber, isoprene rubber, silicone rubber and urethane rubber.

10. The method of claim 1, wherein said thin-wall resilient mold has a thickness of 50 to 2000 μm.

11. The method of claim 1, wherein said mold support is made by cast molding.

12. The method of claim 11, wherein said cast molding is carried out by casting a material selected from the group consisting of liquid polyurethane resin, liquid epoxy resin and liquid gypsum into a mold.

13. The method of claim 12, wherein said cast molding is carried out by casting liquid gypsum into a mold.

14. The method of claim 1, wherein said mold support is made by applying a material.

15. The method of claim 14, wherein said material is selected from the group consisting of water-glass, hydrolysis liquid of metal alkoxide, liquid phenol resin, liquid polyurethane resin, liquid epoxy resin and liquid gypsum.

16. The method of claim 1, wherein said model is removed by melting the model.

17. The method of claim 1, wherein said model is removed by dissolving the model.

18. The method of claim 1, wherein said model is removed by sublimating the model.

19. The method of claim 1, wherein said powder is metal powder.

20. The method of claim 1, wherein said powder is ceramic powder.

21. The method of claim 1, wherein the mold support adheres to the thin-wall resilient mold.

22. The method of claim 5, wherein the material removable by dissolving is urea.

23. The method of claim 6, wherein the material is removable by sublimation is naphthalene.

24. The method of claim 14, wherein the material is applied on the surfaces of the model by brushing, dipping the model in the material or spraying the model with the material.

25. The method of claim 1, wherein the powder is selected from the group consisting of stainless steel powder, high-speed tool steel powder, a mixed powder of tungsten carbide-cobalt, alumina powder, silicon nitride powder, silicon carbide powder and titanium diboride powder.

26. The method of claim 25, wherein the powder comprises spherical particles of a size of 10 to 1000 μm.

27. The method of claim 1, which further comprises applying a mold releasing agent or an adhesive agent to the surface of the thin-wall resilient mold.

28. The method of claim 1, wherein said model is made from paraffin wax having a melting point of 48° to 50° C., said thin wall resilient mold is made from natural rubber, said mold support is made by casting liquid gypsum into a mold and said powder is alumina.

29. The method of claim 1, wherein said model is made from nylon, said thin-wall resilient mold is made from natural rubber, said mold support is made by applying a liquid comprising colloidal silica and alumina on the surface of the thin-wall resilient mold, said mold support adheres to the thin-walled resilient mold, said powder is alumina, and said gas is air.

30. The method of claim 2, wherein said thin-wall resilient mold is made of natural or a synthetic rubber selected from the group consisting of styrene-butadiene rubber, polyisoprene rubber, isobutylene rubber, isoprene rubber, silicone rubber, and urethane rubber, said thin-wall resilient mold has a thickness of 50 to 2000 μm, said mold support is made by casting in a mold a material selected from the group consisting of liquid polyrethane rubber, liquid epoxy resin and liquid gypsum or by applying a material selected from the group consisting of water-glass, a hydrolysis liquid of metal alkoxide, liquid phenol resin, liquid polyurethane resin, liquid epoxy resin and liquid gypsum, said mold support adheres to the thin-wall resilient mold, said powder is selected from the group consisting of metal powder and ceramic powder said gas is air and said model is removed by melting the model, dissolving the model or sublimating the model.

* * * * *